United States Patent [19]

Porter et al.

[11] Patent Number: 5,022,963

[45] Date of Patent: Jun. 11, 1991

[54] WET END CORRUGATING OF ACOUSTICAL TILE

[75] Inventors: William F. Porter, Lake Zurich; Michael G. Mastrogany, Mundelein; Michael J. Porter, Hanover Park, all of Ill.

[73] Assignee: USG Interiors, Inc., Chicago, Ill.

[21] Appl. No.: 361,891

[22] Filed: Jun. 5, 1989

[51] Int. Cl.[5] ..... D21F 11/12

[52] U.S. Cl. ..... 162/116; 162/117; 162/296

[58] Field of Search ..... 162/109, 116, 117, 296; 264/286; 156/42, 45, 347; 181/293; 425/369, 336

[56] References Cited

U.S. PATENT DOCUMENTS

| | | | |
|---|---|---|---|
| Re. 27,109 | 3/1971 | Videen | 162/109 |
| 992,694 | 5/1911 | Smith et al. | 162/109 |
| 1,769,519 | 7/1930 | King et al. . | |
| 1,908,658 | 5/1933 | Dean | 156/347 |
| 1,945,306 | 1/1934 | Dean | 156/347 |
| 2,747,470 | 5/1956 | Jones | 162/116 |
| 3,298,888 | 1/1967 | Page et al. | 156/347 |
| 3,852,083 | 12/1974 | Yang | 106/111 |
| 4,088,112 | 5/1978 | Hight et al. | 125/2 |
| 4,557,973 | 12/1985 | Ali | 136/42 |

*Primary Examiner*—Karen M. Hastings

*Attorney, Agent, or Firm*—Robert H. Robinson; John M. Lorenzen

[57] ABSTRACT

A wet pulp of mineral fibers or the like is forced between a pulp carrier and a corrugated texturing skid inclined toward the downstream end of a moving slab of the pulp. The corrugations of the skid are co-directional with the machine direction of the conveyor belt that transports the pulp under and beyond the skid.

4 Claims, 6 Drawing Sheets

WET END CORRUGATING OF ACOUSTICAL TILE

FIELD OF THE INVENTION

This invention relates to the corrugation of a slab of wet fibrous pulp. More particularly, it relates to a method and apparatus for corrugating the upper surface of a wet slab shortly after its deposition from a headbox. The invention also relates to the corrugated wet slab, itself, which retains the linear lands and grooves when dried for use as a decorative sound absorbing panel.

BACKGROUND OF THE INVENTION

A molding composition comprising a wet pulp of mineral fibers and a binder was taught in U.S. Pat. No. 1,769,519. The owner of that patent, United States Gypsum Company, has been selling a premium line of sound absorbing tiles made according to the '519 process under its ACOUSTONE trademark for more than fifty years. A rough, stone-like appearance is achieved by a casting and screeding technique. It has proven difficult to generate linear patterns on the wet pulp uniformly and reproducibly at commercially feasible costs.

The creation of linear patterns in a highly fibrous acoustical tile is often achieved by routing or sandblasting of the dry blanks. Each of these requires special equipment and expertise. Molding of the tile is conditioned upon the pulp remaining in the mold while some change, e.g. curing, drying, or setting, causes the features of the pattern to become self-sustaining.

A plastic plaster composition containing as much as 30% by weight of natural fibers is taught in U.S. Pat. No. 3,852,083 as being extrudable and moldable. Consistently good results are obtained only when a latex and a hydromodifier such as methyl cellulose are present along with the plaster and fiber. The hydromodifier enables the composition to leave the extrusion die as a smooth homogeneous column whose dimensions remain the same as the die opening. The structures obtained by the extrusion are said to be generally shape-retaining but the desirability of supporting them against deformation by gravity is also taught.

Page et al teach in U.S. Pat. No. 3,298,888 a process and apparatus for high speed, low cost manufacture of a ribbed gypsum board having paper faces. A slurry of calcined gypsum which may contain fibers is introduced between a flat bottom sheet and a pleated upper sheet in sufficient volume to fill the pleats and thereby form the ribs. The paper remains on the gypsum even after it has set, the height of the ribs having been gauged to a uniform value while the slurry has partially set but is still plastic.

It is an object of this invention, therefore, to provide a method for creating well-defined linear textures in a moving slab of wet fibrous pulp.

It is another object of this invention to provide apparatus for corrugating the surface of such a slab.

It is a further object of this invention to provide a wet pulpy slab of fibers having discrete, self-sustaining linear impressions in its surface ranging from that of a keyboard to a checkerboard to a corduroy fabric.

These and other objects are achieved by the method and apparatus described herein with reference to the drawings.

SUMMARY OF THE INVENTION

Now, it has been discovered that a wet pulpy mass of mineral fibers, wood fibers, or the like may be corrugated by forcing a slab of the pulp against a texturing skid having corrugations co-directional with the movement of the slab, thereby impressing discrete lineal grooves and lands on the surface of the pulp.

DETAILED DESCRIPTION OF THE INVENTION

Figure 1:
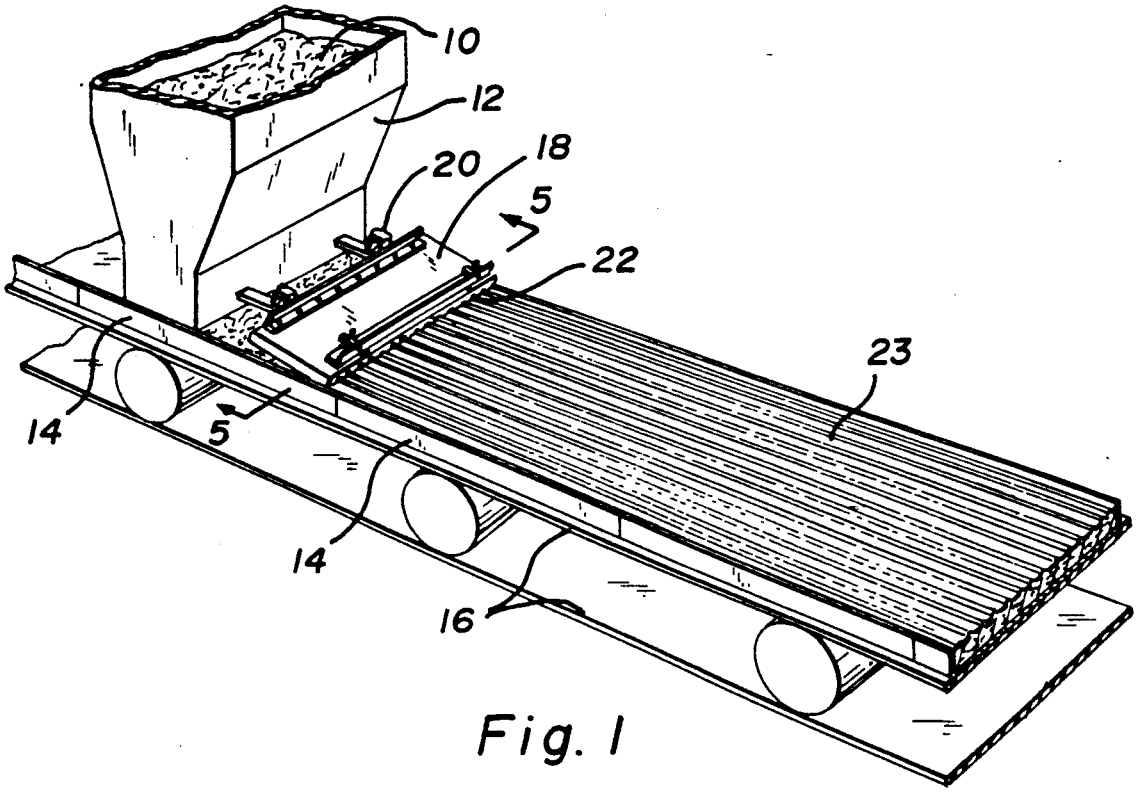
FIG. 1 is a perspective view of apparatus of this invention showing a wet fibrous pulp supported by pulp carriers being corrugated soon after its exit from a head box.
Figure 5:
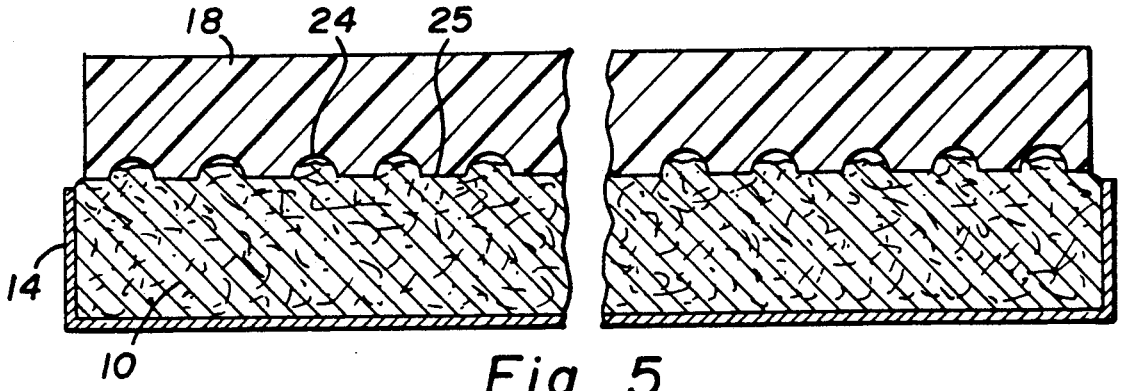
FIG. 5 is a sectional view taken along line 5—5 of FIG. 1.
Figure 5A:
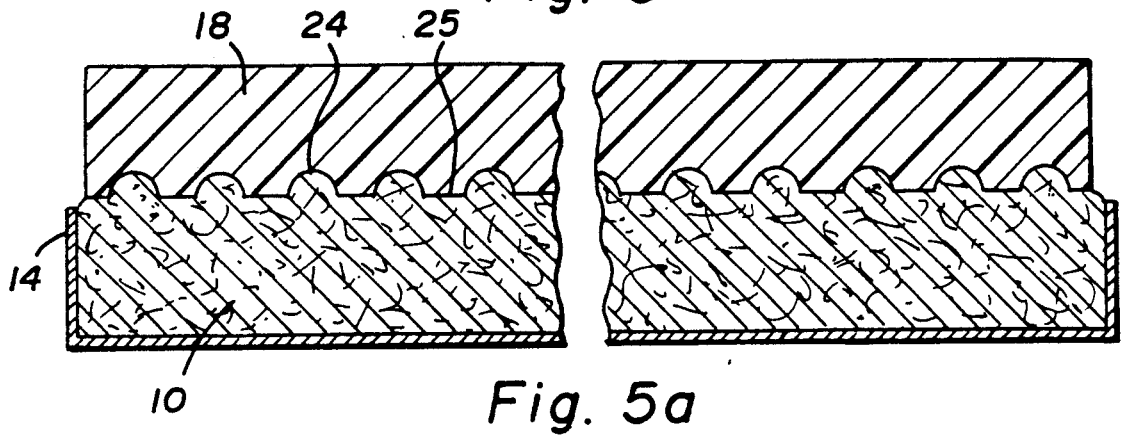
FIG. 5*a* is an alternative sectional view taken along line 5—5 of FIG. 1.
Figure 6:
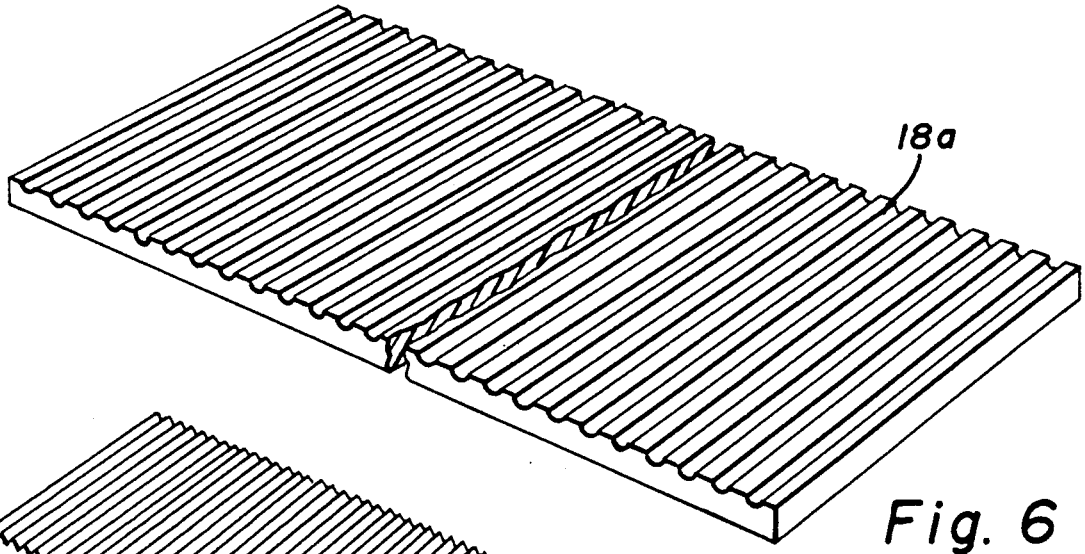
FIGS. 6 and 7 are perspective views of two embodiments of a texturing skid of this invention.
Figure 7:
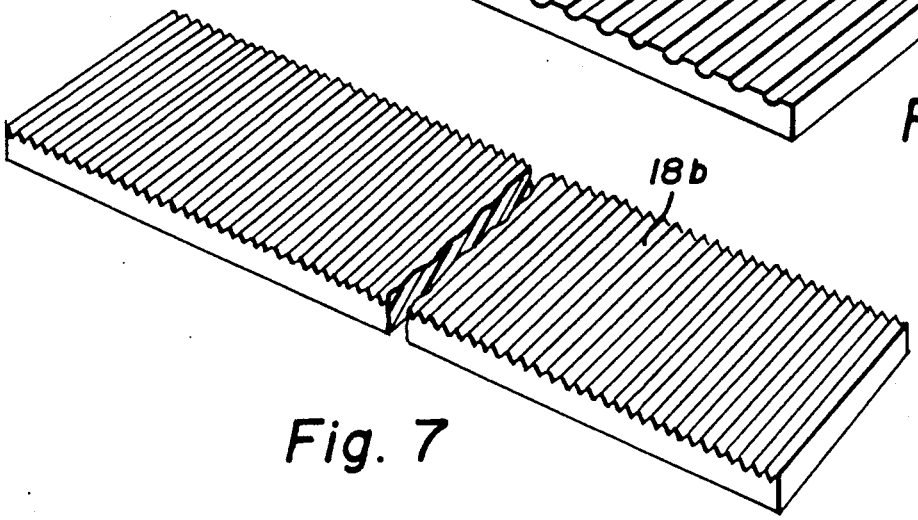
Figure 8:
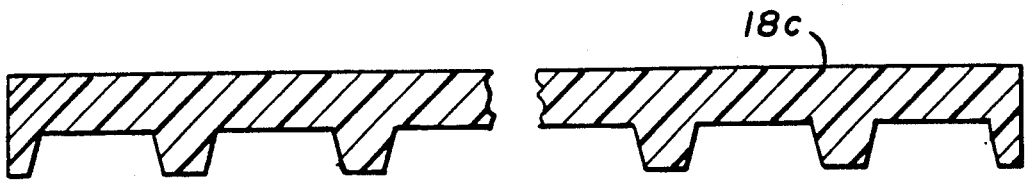
FIGS. 8, 9 and 10 are cross sections of three other embodiments of the texturing skid of this invention.
Figure 9:
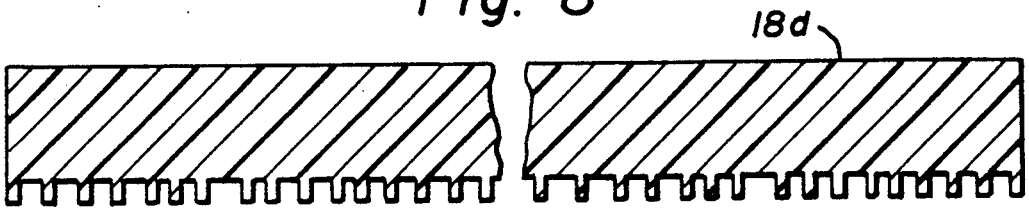

In FIG. 1, the wet pulp 10 is distributed by the head box 12 across the breadth of the pulp carrier pans 14 which are transported by the conveyor belt 16 at a line speed of about 40 to 55 feet per minute. The pulp is forced against the corrugated texturing skid 18 which inclines from the pintles 20 toward the wet pulp 10 downstream from the head box. The corrugated surface 22 of the skid 18 is the negative of the pattern impressed on the wet pulpy slab 23. The forcing of the pulp into the grooves 24 and around the lands 25 is shown more clearly in FIGS. 2, 5 and 5*a*. A partial filling of the grooves as in FIG. 5 may be desired for its natural stone look or a more sculptured appearance may be had by filling them fully as in FIG. 5*a*.

Figure 2:
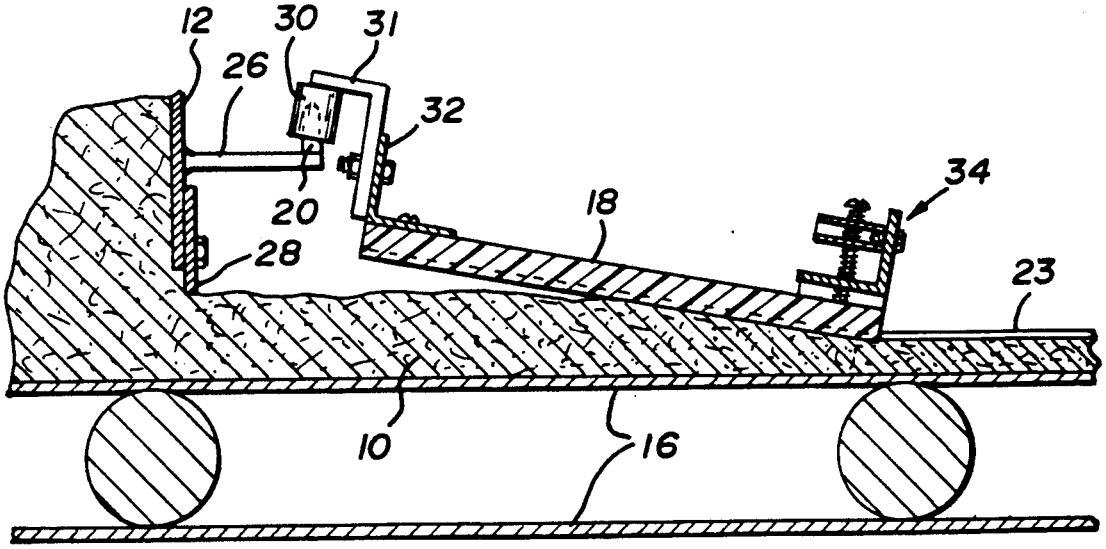
FIG. 2 is a cross section of the apparatus of FIG. 1.

The mounting of the stationary skid 18 is shown in FIG. 2 wherein the pintle 20 stands on the ledge 26 which projects from the head box 12 just above the gate 28. The socket 30 capping the pintle 20 is connected to the skid 18 by the angle irons 31 and 32 and their respective fasteners. The socket 30 is free to articulate around the pintle in all directions to accomodate movements of the skid in response to the flow of the wet pulp 10 against the skid.

Figure 3:
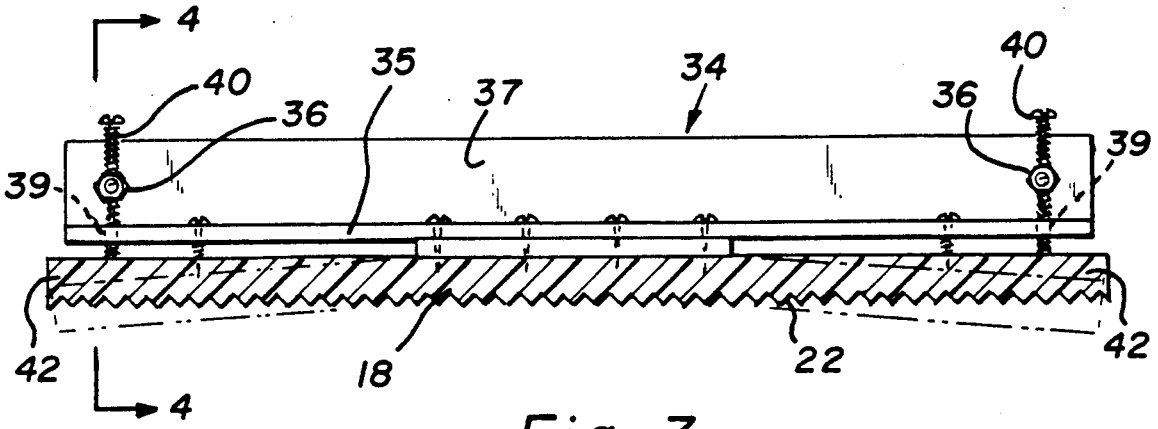
FIG. 3 is a cross section of a preferred texturing skid of this invention.
Figure 4:
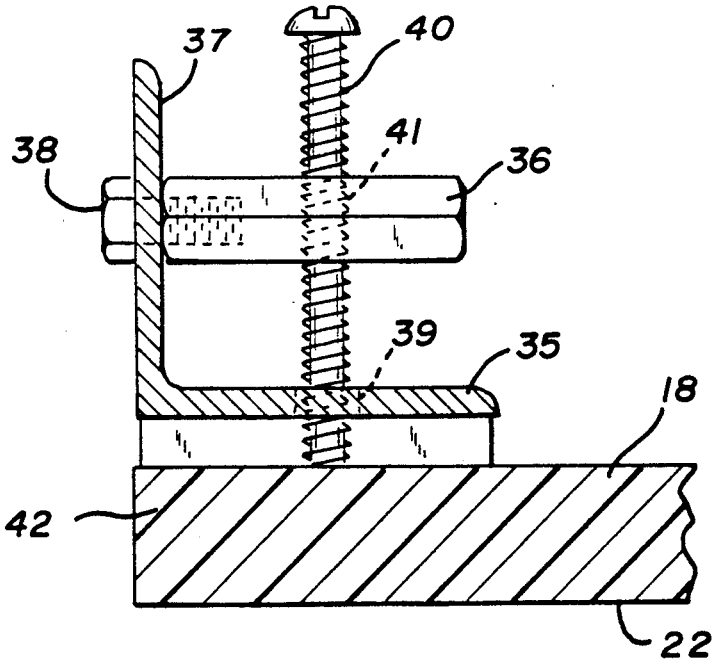
FIG. 4 is a sectional view of the skid of FIG. 3 taken along line 4—4 thereof.

The bending member 34, shown in more detail in FIGS. 3 and 4, spans the breadth of the skid 18 and attached at the middle region thereof is the base leg 35 of an angle iron. The connector nuts 36 are attached to the upright leg 37 of the angle iron by the bolts 38 and they project out over the base leg 35 which has a hole 39 near each of the opposite ends thereof. The adjusting screws 40 engage the threaded bores 41 through the nuts 36 and pass freely through the holes 39 to urge the lateral ends 42 of the skid 18 away from the leg 35 and thus cause the corrugated surface 22 to become slightly concave to register with the slightly convex surface of the wet pulp 10.

Figure 10:
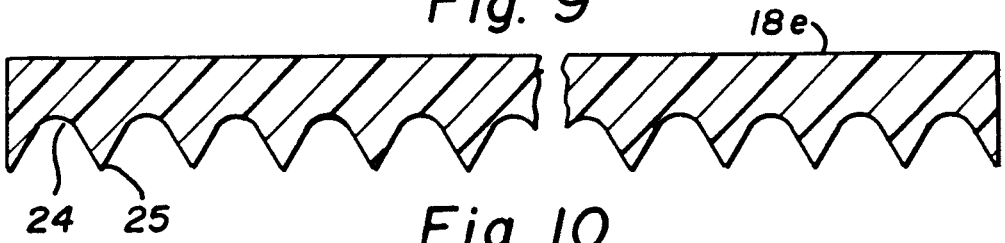

The various patterns that may be imparted to acoustical tile by this invention are exemplified by those of the skids 18*a*–18*e* in FIGS. 5–10. A preferred pattern for the corrugations on the skid 18*e* is shown in FIG. 10 wherein the profile of each groove 24 is an arc of a circle along with a tangential extension thereof at each end of the arc. The tangents to adjacent circular segments intersect with one another and the vertex formed thereby constitutes the profile of a land 25. The greater the angle between the tangents, the broader will be the profile of a land. Said profiles facilitate complete packing of the wet pulp into the grooves and afford strong lands which can withstand the lateral forces of the packing. A vertex of 60° as shown in FIG. 10 is suitable, as are others from about 30° to 90° or more. Lands as thin as about 1/64 of an inch may be used, however.

Figure 11:
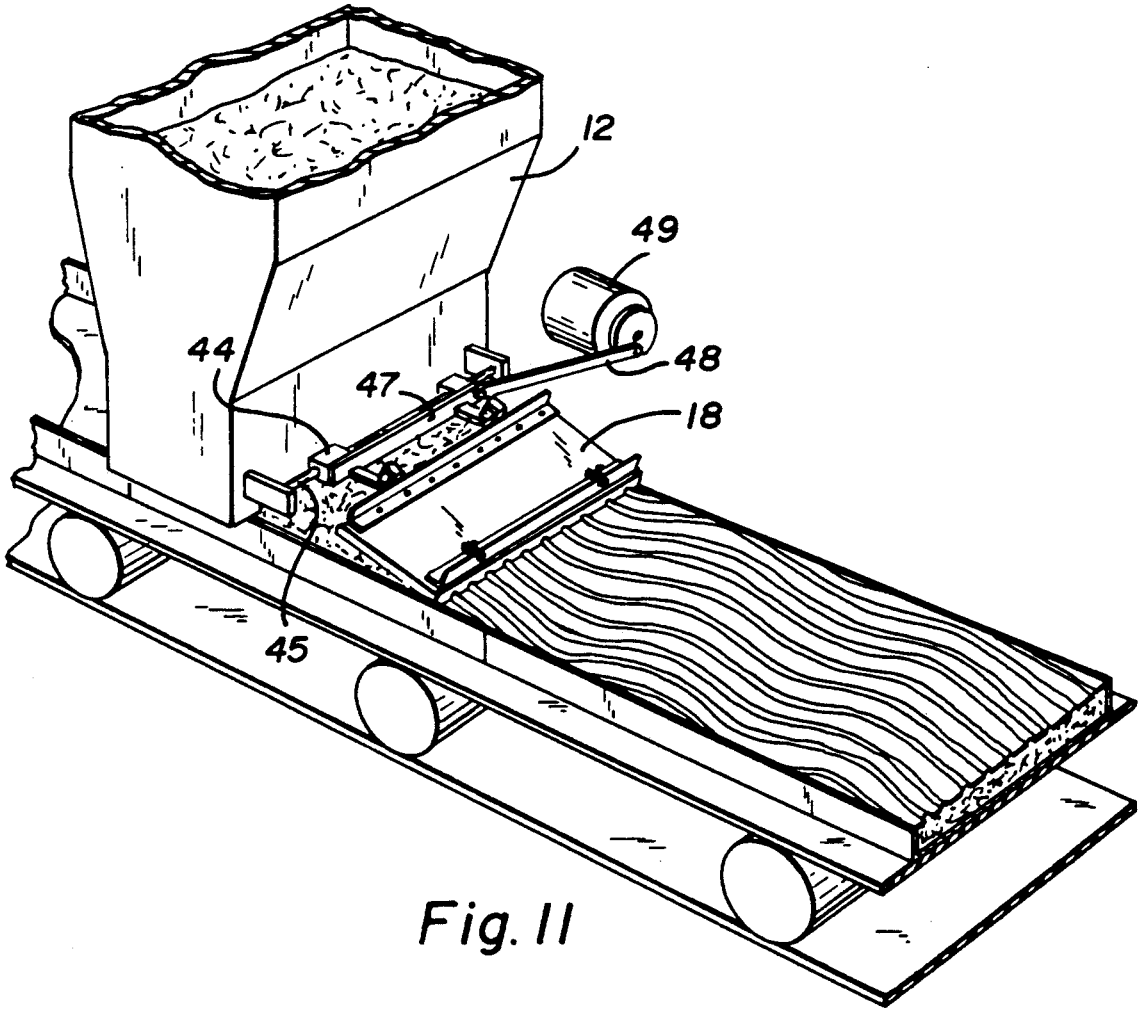
FIG. 11 is a perspective view of another embodiment of the corrugating apparatus of this invention.

A serpentine corrugation may be imparted to the wet pulpy slab by reciprocating the skid 18 which is mounted on the linear bearings 44 which slide on the horizontal shaft 45 and are connected by the rod 47 which in turn is connected to the reciprocating arm 48 and the motor 49 as in FIG. 11.

Figure 12:
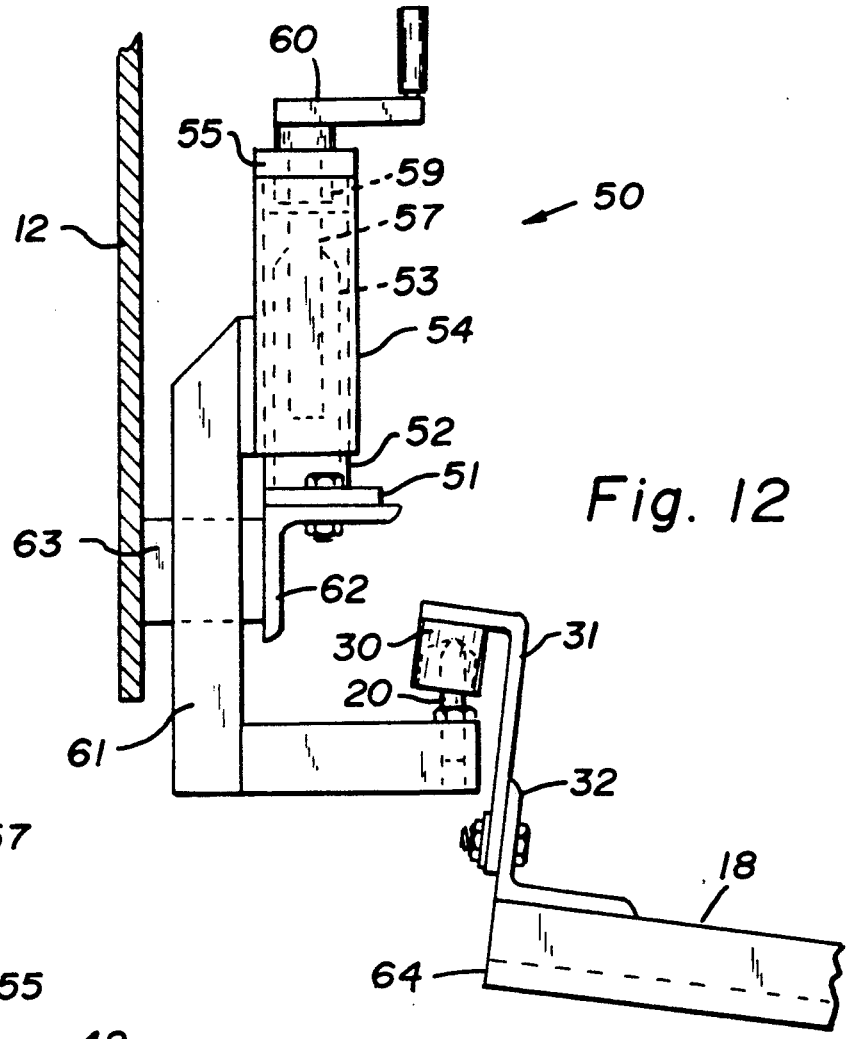
FIG. 12 is a diagrammatic view of a jack in association with a texturing skid of this invention.
Figure 13:
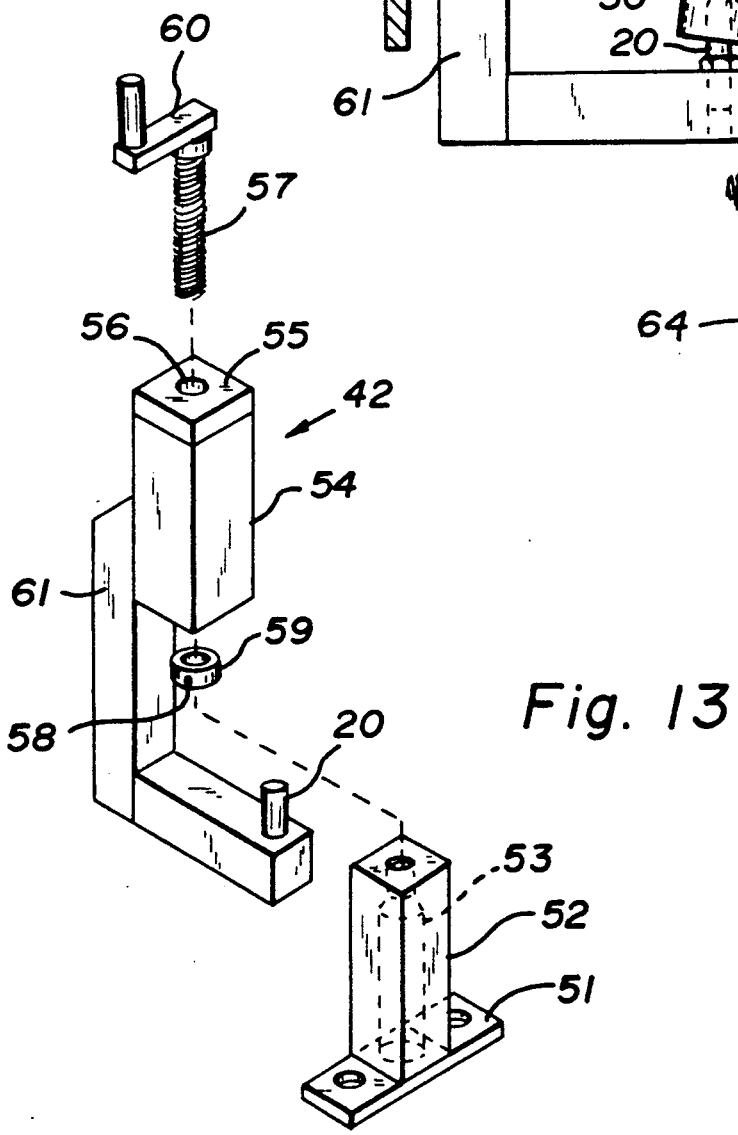
FIG. 13 is an exploded perspective view of the jack of FIG. 12.

The angle of inclination of the skid 18 may be conveniently and reproducibly adjusted up to about 30° by operation of the jack 50 shown in FIGS. 12 and 13. The base 51 is welded to the upright body 52 which has the partially threaded bore 53. The tube 54 along with its cap 55 envelop the upright body and the hole 56 in the cap is aligned with the bore 53 to allow passage of the screw 57 which engages the threads therein. Surrounding the upper end of the screw and fastened thereto by the set screw 58 is the collar 59 which bears against the underside of the cap 55. The crank 60 is integral with the screw. Welded to the tube 54 is the L-shaped bracket 61 upon which the mounting pin or pintle 20 is mounted. The jack 50 is mounted on the angle iron 62 which in turn is supported by the brackets 63 which extend from the head box 12 on both lateral sides of the conveyor belt 16. Alternatively, angle iron 62 may be supported by uprights spaced away downstream from the headbox. Precise and reproducible adjustments of the height of the leading edge 64 of the skid 18 may be made by turning the crank 60 to raise or lower the pintle 20 and the socket 30. It is preferred to use a jack at each lateral margin of the skid.

Figure 14:
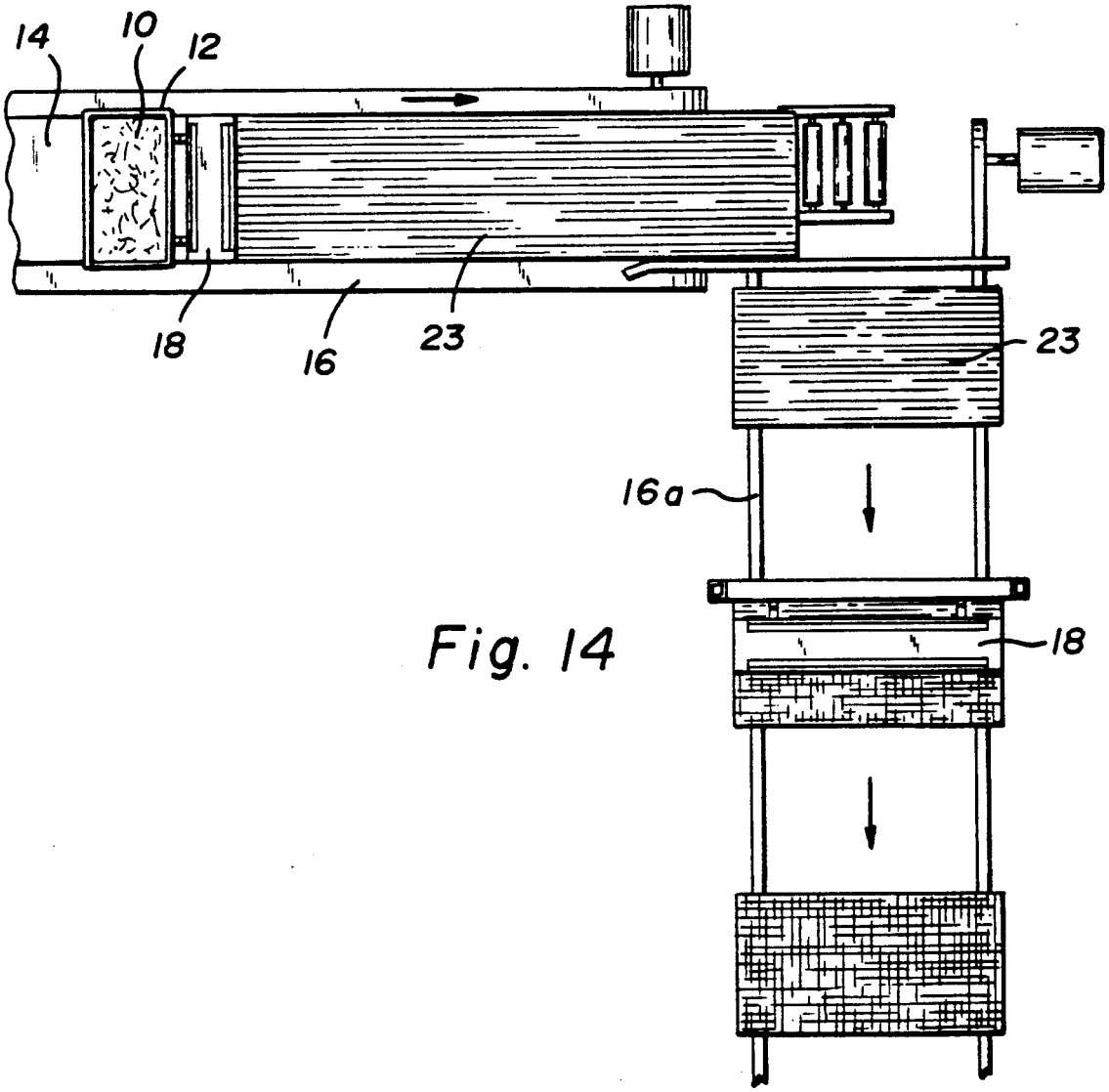
FIG. 14 is a plan view showing the apparatus of claim 1 disposed at right angles to a second corrugating device.

A grid pattern or checkerboard impression may be created by bumping the corrugated wet slab 23 off of the conveyor belt 16 onto a second conveyor belt 16*a* which moves at right angles to the belt 16 and forcing the wet pulp into the grooves and around the lands of a second texturing skid 18 as shown in FIG. 14.

Two effects of the friction generated by the rough mineral fibers in the wet pulp as it is forced against the surface 22 of the skid 18 by the movement of the conveyor belt 16 are a wearing away of the surface and a slowing of the conveyor belt speed. To minimize those effects, the skid 18 or at least the surface 22 is preferably made of a low friction material such as high density polyethylene, an ABS plastic, or poly-(tetrafluoroethylene) sold under the trademark TEFLON by duPont. A wear resistant material such as a chrome-plated metal or plastic is particularly preferred. The area of contact between the wet pulp and the surface 22 should be minimized to the extent consistent with a sharp definition of the lands and grooves. The length of the surface 22 in the machine direction has been as small as about 1 inch (25.4 mm) when corrugating a wet slab having a 2 foot (61 cm) width but longer machine direction lengths are more suitable when the grooves 24 are very narrow and close together. Grooves as narrow as about one-eighth inch (3.2 mm), measured from vertex to vertex on the skid 18*e* for example, have been used in the practice of this invention. When such narrow grooves are spaced closely together, the total area to be packed with the wet pulp in a short time is rather large and it is useful to press down on the skid to help the packing. A hydraulic press may be connected to the skid 18 or weights may be simply laid on it to impose a load of up to about 1 psi. The skid is in contact with the wet pulp for from about 1 second to about 6 seconds.

The low angle of inclination of the skid 18 is another feature of the invention designed to minimize the wear on the surface 22 and the drag on the conveyor. A plow-like action by the skid is not acceptable because that would tear up the fibrous pulp but a large vertical vector for the position of the skid is also to be avoided because that would tend to block passage of the pulp rather than let it slip into the grooves and move within them until they are fully packed. A skid having an upswept leading edge also allows the wet pulp to slip into the grooves at a shallow angle. The radius of curvature is suitably about 3 inches but it may be greater. Such a skid is disposed above the pulp carrier and substantially parallel thereto so that the major planar portion of the skid glides on the wet pulp deposited on the carrier.

Although the wet pulp has been discussed with reference to mineral fibers and particularly to granulated mineral fibers as taught in U.S. Pat. No. 1,769,519, which is incorporated herein by reference, this invention is also suitable for the corrugation of wet wood fiber pulps and other highly fibrous masses having flow properties similar to the pulp of the '519 patent. A highly fibrous mass, for the purposes of this invention, is one containing from about 6% to about 25% or more fiber by weight of the wet mass. A typical pulp contains about 21% mineral fiber, about 72% water, about 3% stucco and about 4% starch by weight.

The subject matter claimed is:

1. A method for imparting a corrugated texture to a highly fibrous mass designed to be converted into acoustical tiles comprising:

(1) forming a mineral fiber pulp in a head box, said pulp containing from about 6% to about 25% of mineral fiber by weight of the wet pulp;

(2) distributing the pulp from the head box across the breadth of a first pulp carrier means, said carrier means having a line speed of about 40 to 55 feet per minute;

(3) forcing the pulp into contact with a corrugated surface of a first, unitary texturing skid with no prior scoring of the pulp, said corrugated skid surface having grooves and being inclined at an acute angle of 30° or less at the point of contact with said pulp, and said skid having lateral ends to which pressure is applied causing the corrugated surface of the skid to become slightly concave and to register with a slightly convex surface of the pulp;

(4) maintaining said pulp in contact with said skid for about 1 to about 6 seconds;

(5) impressing a pattern in said pulp by means of said skid whereby pulp is forced into the grooves formed by the surface of the skid, with the corrugated surface of the skid being the negative of the pattern impressed in the pulp.

(6) drying the pulp having the impressed pattern retained therein; and (7) recovering an acoustical tile material.

2. The method of claim 1 wherein the pulp formed in step 1 contains by weight about 21% mineral fiber, about 72% water, and 3% stucco and about 4% starch.

3. The method of claim 1 wherein the skid is reciprocated laterally across the carrier means while in contact with the pulp so as to form a serpentine corrugation pattern in the pulp.

4. A method for imparting a corrugated texture to a highly fibrous mass designed to be converted into acoustical tiles comprising:

(1) forming a mineral fiber pulp in a head box, said pulp containing from about 6% to about 25% of mineral fiber by weight of the wet pulp;

(2) distributing the pulp rom the head box across the breadth of a first pulp carrier means, said carrier means having line speed of about 40 to 55 feet per minute;

(3) forcing the pulp into contact with a corrugated surface of a first, unitary texturing skid with no prior scoring of the pulp, said corrugated surface having grooves and being inclined at an acute angle of 30° or less at the point of contact with said pulp;

(4) maintaining said pulp in contact with said skid for about 1 to about 6 seconds;

(5) impressing a pattern in said pulp by means of said skid whereby pulp is forced into the grooves formed by the surface of the skid, with the corrugated surface of the skid being the negative of the pattern impressed in the pulp, (6) placing the pulp on a second carrier means at a right angle to said first carrier means and moving the still wet and corrugated pulp into contact with a corrugated surface of a second skid also at a right angle to said first skid whereby a grid pattern is impressed in the pulp, (7) drying the pulp having the impressed pattern retained therein; and (8) recovering an acoustical tile material.

* * * * *